US011780717B2

(12) United States Patent
He et al.

(10) Patent No.: US 11,780,717 B2
(45) Date of Patent: Oct. 10, 2023

(54) JACK WITH A PROTECTING STRUCTURE OF A PUMP PISTON AND METHOD FOR USING THE SAME

(71) Applicant: FUYANG TONGLI INDUSTRIAL CO., LTD., Hangzhou (CN)

(72) Inventors: Guoliang He, Hangzhou (CN); Weixiang He, Hangzhou (CN); Gang Sun, Hangzhou (CN); Guannan Lu, Hangzhou (CN); Hangfeng Li, Hangzhou (CN)

(73) Assignee: FUYANG TONGLI INDUSTRIAL CO., LTD., Hangzhou (CN)

( * ) Notice: Subject to any disclaimer, the term of this patent is extended or adjusted under 35 U.S.C. 154(b) by 291 days.

(21) Appl. No.: 17/209,217

(22) Filed: Mar. 23, 2021

(65) Prior Publication Data

US 2021/0316973 A1 Oct. 14, 2021

(30) Foreign Application Priority Data

Apr. 14, 2020 (CN) ..... 202010291657.3

(51) Int. Cl.
*B66F 5/04* (2006.01)
*F04B 9/14* (2006.01)
*F04B 53/14* (2006.01)

(52) U.S. Cl.
CPC ..... *B66F 5/04* (2013.01); *F04B 9/14* (2013.01); *F04B 53/14* (2013.01); *B66F 2700/057* (2013.01)

(58) Field of Classification Search
CPC ..... B66F 5/04; B66F 2700/057; B66F 1/08; B66F 1/025; B66F 3/26; B66F 3/25; B66F 13/00; B66F 17/00; F04B 9/14; F04B 53/14
See application file for complete search history.

(56) References Cited

U.S. PATENT DOCUMENTS 2,032,309 A * 2/1936 Rechard ..... B66F 5/04 254/2 B
2,039,896 A * 5/1936 Green ..... B66F 5/04 254/2 B
4,018,421 A * 4/1977 Tallman ..... B66F 5/04 254/8 B
4,131,263 A * 12/1978 John ..... B66F 3/42 254/8 B (Continued)

*Primary Examiner* — Brian D Keller
*Assistant Examiner* — Tim Brady
(74) *Attorney, Agent, or Firm* — Bayramoglu Law Offices LLC

(57) ABSTRACT

A jack with a protecting structure of a pump piston and a method for using the same are provided. The jack includes a housing, a base located inside the housing, and the protecting structure. An oil cylinder and a pump body are installed on the base. A pump piston is installed on the pump body. A spring is installed on the pump piston and the pump body. A stop protrusion is arranged on the pump piston. The protecting structure includes a dustproof sleeve and a wool felt. The dustproof sleeve is installed on the base and the pump piston. One end of the dustproof sleeve is detachably fixed on the base through a fastener. The other end of the dustproof sleeve is connected to an end portion of the pump piston. The shape of the dustproof sleeve is set into a wavy type.

16 Claims, 5 Drawing Sheets

(56) References Cited

U.S. PATENT DOCUMENTS

| | | | | | |
|---|---|---|---|---|---|
| 5,201,494 | A * | 4/1993 | Lundman | B66F 5/04 | 254/8 B |
| 5,580,447 | A * | 12/1996 | Platter | F04B 53/123 | 210/416.3 |
| 6,491,067 | B1 * | 12/2002 | Davenport | H02G 15/18 | 138/156 |
| 7,036,796 | B2 * | 5/2006 | Hsu | B66F 5/04 | 254/8 B |
| 10,654,696 | B2 * | 5/2020 | Wu | B66F 5/04 | |
| 2015/0175394 | A1 * | 6/2015 | Shen | B66F 5/04 | 254/93 R |
| 2017/0158473 | A1 * | 6/2017 | Wu | B66F 5/04 | |

* cited by examiner

JACK WITH A PROTECTING STRUCTURE OF A PUMP PISTON AND METHOD FOR USING THE SAME

CROSS REFERENCE TO THE RELATED APPLICATIONS

This application is based upon and claims priority to Chinese Patent Application No. 202010291657.3, filed on Apr. 14, 2020, the entire contents of which are incorporated herein by reference.

TECHNICAL FIELD

The present invention relates to a jack, and more particularly, to a jack with a protecting structure of a pump piston and a method for using the same.

BACKGROUND

There are generally two types of jacks, vertical and horizontal. Many components are arranged on the jack depending on the application. A pump piston is a crucial component of the horizontal jack. The pump piston is lifted for pumping the oil. When the pump piston is being lifted, the pump piston and a spring are exposed and susceptible to the external environment, causing an amount of dust to accumulate on the pump piston and the spring. In addition, in wet humid environments, it makes the pump piston and spring more likely to rust, which seriously affects the normal work of the jack, and even causes the jack to lose its lifting function. Additionally, the service life of the spring is shortened due to long-term operation and rust, and the pump piston cannot work normally after the spring is worn, which also causes the jack to lose its lifting function.

Chinese patent CN201080418Y discloses a push-pull adjustable hydraulic horizontal jack, which includes a base, a main bracing arm, an auxiliary bracing arm, a cylinder base, a press rod base, a top base, an oil cylinder, an oil pump, an oil discharge valve, a press roller, a press rod, an oil cylinder piston, and an arm base. Specifically, the main bracing arm, the auxiliary bracing arm, the cylinder base, and the press rod base are arranged on the base, respectively. The top base is installed on the tops of the main bracing arm and the auxiliary bracing arm. The oil cylinder, the oil pump, and the oil discharge valve are arranged on the cylinder base, respectively. The press roller is arranged on the press rod base and corresponds to the oil pump. The press rod is installed on the press rod base and connected to the oil discharge valve. The oil cylinder piston is arranged on the oil cylinder. The arm base is connected to the oil cylinder piston In the working process, the press rod is pressed, and the oil pump is pressed by the press roller on the back of the press rod, so that the oil pump pumps oil to push the oil cylinder piston in the oil cylinder to move forward, and then the oil cylinder piston drives the arm base to move forward together. The oil pump of this patented horizontal jack, however, is not equipped with a dustproof structure, it is easily damaged in a severe environment due to its lack of protection.

Chinese patent CN207483247U discloses a transportable horizontal jack capable of protecting a pump piston, including a handle for easily carrying the horizontal jack and protecting the pump piston, an oil pump component, a wall panel, a lifting arm component, a hand-press portion, the pump piston, a front wheel, a rear wheel, and a rear wheel protecting frame. The handle is fixed on the rear wheel protecting frame or the wall panel by bolting or welding or snap-fitting. The handle is not only used as a traditional handle in the actual use process, and but also can effectively protect the pump piston of the oil pump from being damaged by other external objects, so as to effectively prolong the service life of the oil pump. This set up, however, protects only the oil pump from damage caused by contact with external objects. It does not protect the oil pump from dust and moisture.

It is, therefore, highly desirable to provide an improved jack with a protecting structure of a pump piston and a method for using the same.

SUMMARY

In order to solve the above problems, an objective of the present invention is to provide a jack with a protecting structure of a pump piston and a method for using the same.

In order to achieve the above objective, the present invention adopts the following technical solution. A jack with a protecting structure of a pump piston includes a housing and a base located inside the housing. An oil cylinder and a pump body are installed on the base. A pump piston is installed on the pump body. A spring is installed on the pump piston and the pump body. A stop protrusion is arranged on the pump piston. The jack further includes a protecting structure. The protecting structure includes a dustproof sleeve and a wool felt. The dustproof sleeve is installed on the base and the pump piston. One end of the dustproof sleeve is detachably fixed on the base through a fastener. A press ring is installed between the dustproof sleeve and the fastener. The base is further provided with a vent, and the wool felt is installed in the vent.

Further preferably, a cushion plate is installed between the spring and the top end of the dustproof sleeve of the protecting structure. A press plate is installed between the top end of the dustproof sleeve and the stop protrusion.

Further preferably, the configuration of the dustproof sleeve of the protecting structure is wave-shaped.

Further preferably, a wheel shaft is installed on the housing, and wheels are installed at both ends of the wheel shaft. A piston rod is installed on the oil cylinder. A connecting rod is installed at an end portion of the piston rod, and short connecting rods are installed at both ends of the connecting rod.

Further preferably, a lifting arm and a web plate are movably installed on both sides of each of the short connecting rods. A lifting arm shaft is installed on the housing, and a lifting arm sleeve is installed on the lifting arm shaft. The web plate is provided with a limit groove matched with the lifting arm sleeve. The lifting arm is movably connected to the lifting arm shaft through the lifting arm sleeve.

Further preferably, long connecting rods are movably installed on the lifting arm, and a pallet shaft is movably installed on the long connecting rods. A pallet base is installed on the pallet shaft, and a pallet base shaft is installed on the pallet base. A pallet is installed on the pallet base shaft through a pin. The other end of the lifting arm is connected to the pallet base through the pallet base shaft. A spacer shaft is installed on the housing. A reinforcing plate is installed on each of the lifting arm, the web plate and the pallet base.

Further preferably, a hand-press portion pin shaft and a hand-press portion limit rod are installed on the housing. A hand-press portion is movably installed on the hand-press portion pin shaft. A hand-press portion roller shaft is installed on the hand-press portion, and hand-press portion rollers are movably installed on the hand-press portion roller shaft. The hand-press portion is provided with a hand-press portion socket, and a handle is installed in the hand-press portion socket.

Further preferably, an assembly mode of the protecting structure includes:

step 1: installing the spring on the base, wherein the pump body is already installed on the base;

step 2: successively sleeving the press plate, the dustproof sleeve and the cushion plate on the stop protrusion of the pump piston;

step 3: plugging the wool felt into the vent located in the base;

step 4: installing the pump piston on the pump body, wherein the press plate, the dustproof sleeve and the cushion plate have been already installed on the pump piston; and step 5: sleeving the press ring into the dustproof sleeve, and fixing the press ring and the dustproof sleeve on the base through the fastener.

Further preferably, one end of the dustproof sleeve is fixed between the press plate and the cushion plate through the spring mounted on the pump body and the stop protrusion located on the pump piston. The other end of the dustproof sleeve is fixed on the base by the fastener and the press ring.

A method for using the jack with the protecting structure of the pump piston includes: firstly, manually moving the jack to a workplace through the wheels, and then inserting one end of the handle into the hand-press portion socket; repeatedly pressing the handle by hands, driving the pump piston and the spring by the handle through the hand-press portion rollers to perform a retractile action, and driving the dustproof sleeve by the pump piston to perform a synchronous retractile action; wherein the dustproof sleeve plays a dustproof role, and in the process of the synchronous retractile action of the dustproof sleeve, the dustproof sleeve is retractable and has an elastic characteristic to alleviate the reaction force of the spring during return, which prolongs a service life of the spring; when the pump piston performs the retractile action, injecting hydraulic oil into the oil cylinder, wherein a pressure of the hydraulic oil in the oil cylinder pushes the piston rod; the piston rod pushes the connecting rod, the connecting rod drives the lifting arm to move through the short connecting rods, the lifting arm moves to drive the pallet base and the pallet to move upward through an action of the long connecting rods, and the lifting arm lifts the pallet upward and plays a role of jacking up.

In the present invention, the dustproof sleeve is arranged on the pump body and the pump piston, and the shape of the dustproof sleeve is set into a wavy type. One end of the dustproof sleeve is fixedly connected to the base, and the other end of the dustproof sleeve is connected to an end portion of the pump piston. In this way, the dustproof sleeve can effectively retract and stretch within the whole stroke of the pump piston and can effectively prevent dust. The base is provided with the vent, and the wool felt is installed in the vent, so as to effectively prevent secondary contamination.

In the figures: 1. housing; 2. base; 3. oil cylinder; 4. pump body; 5. pump piston; 6. dustproof sleeve; 7. press ring; 8. vent; 9. wool felt; 10. spring; 11. stop protrusion; 12. cushion plate; 13. press plate; 14. wheel shaft; 15. wheel; 16. piston rod; 17. connecting rod; 18. short connecting rod; 19. lifting arm; 20. web plate; 21. lifting arm shaft; 22. lifting arm sleeve; 23. long connecting rod; 24. pallet shaft; 25. pallet base; 26. pallet base shaft; 27. pallet; 28. spacer shaft; 29. reinforcing plate; 30. hand-press portion pin shaft; 31. hand-press portion limit rod; 32. hand-press portion; 33. hand-press portion roller shaft; 34. hand-press portion roller; 35. hand-press portion socket; 36. handle; and 37. limit groove.

DETAILED DESCRIPTION OF THE EMBODIMENTS

A jack with a protecting structure of a pump piston and a method for using the same according to the present invention will be further described below in combination with the drawings.

Figure 1:
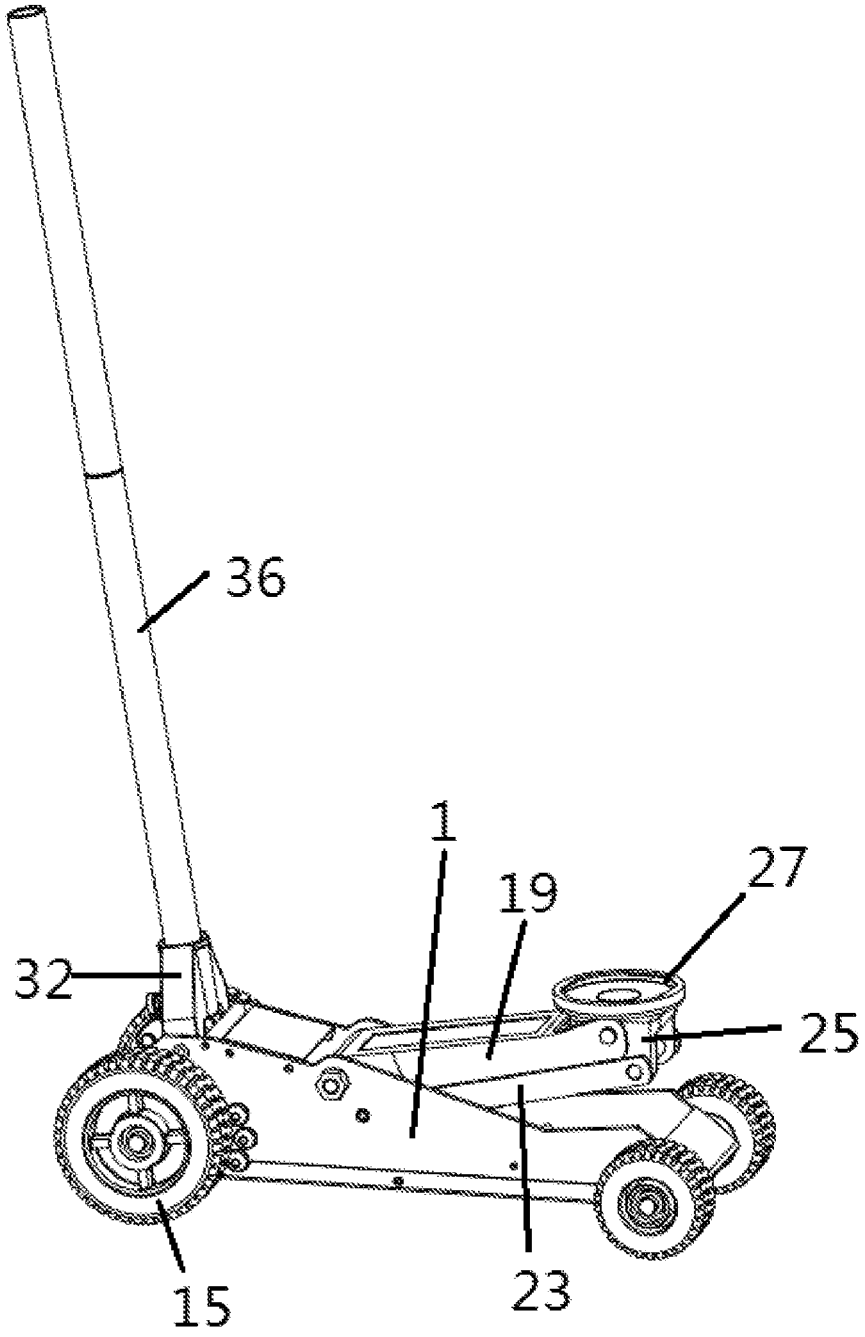
FIG. 1 is a schematic diagram of the structure of the present invention.
Figure 2:
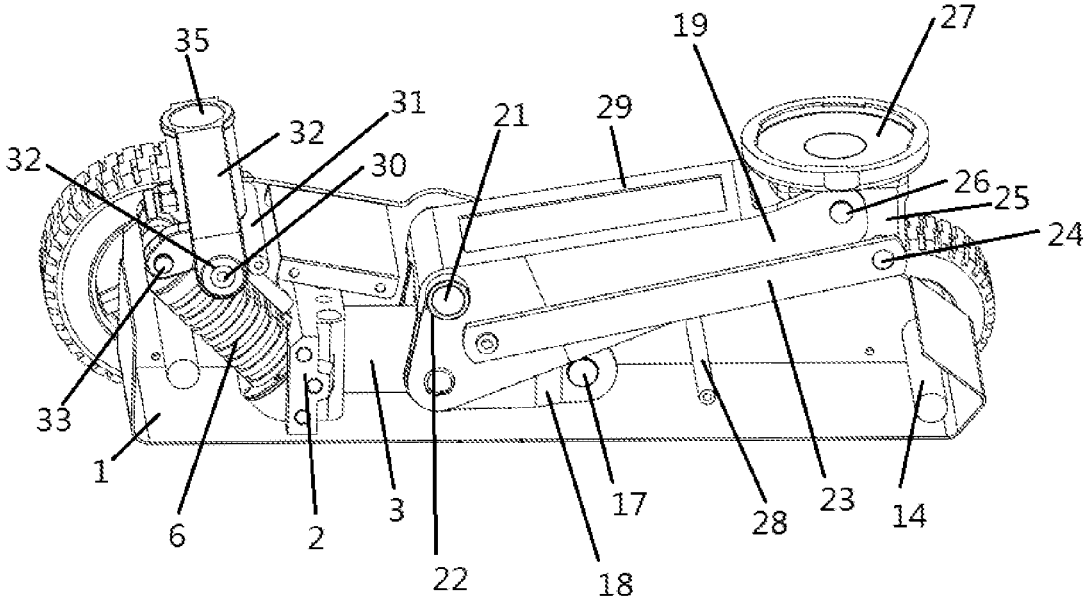
FIG. 2 is a schematic diagram of the structure of the present invention, wherein a side of the housing is hidden.
Figure 3:
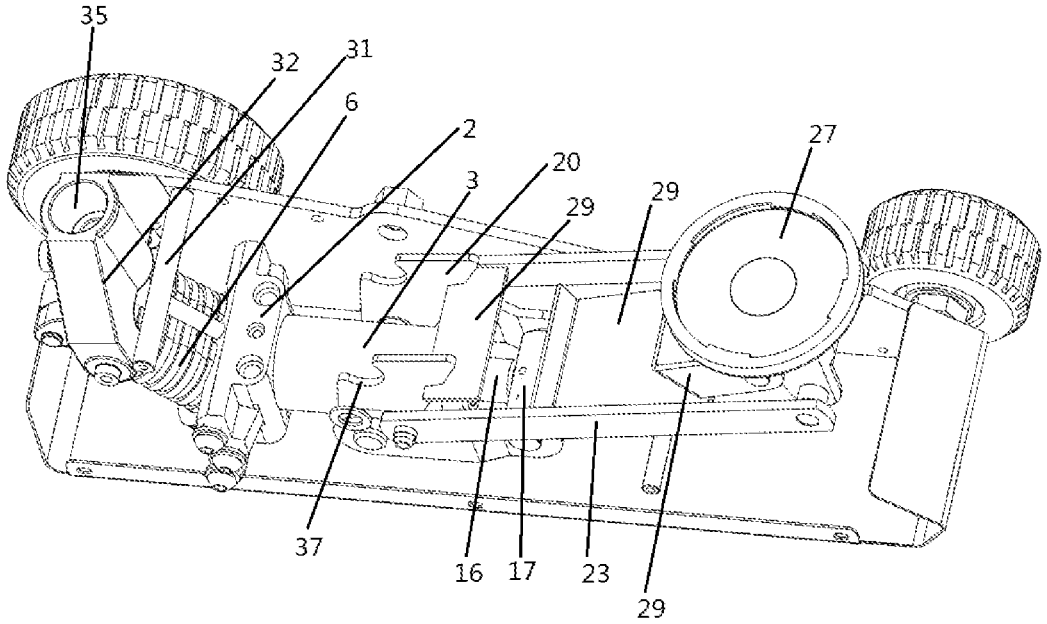
FIG. 3 is a schematic diagram of the structure of the present invention from another perspective, wherein the side of the housing is hidden.
Figure 4:
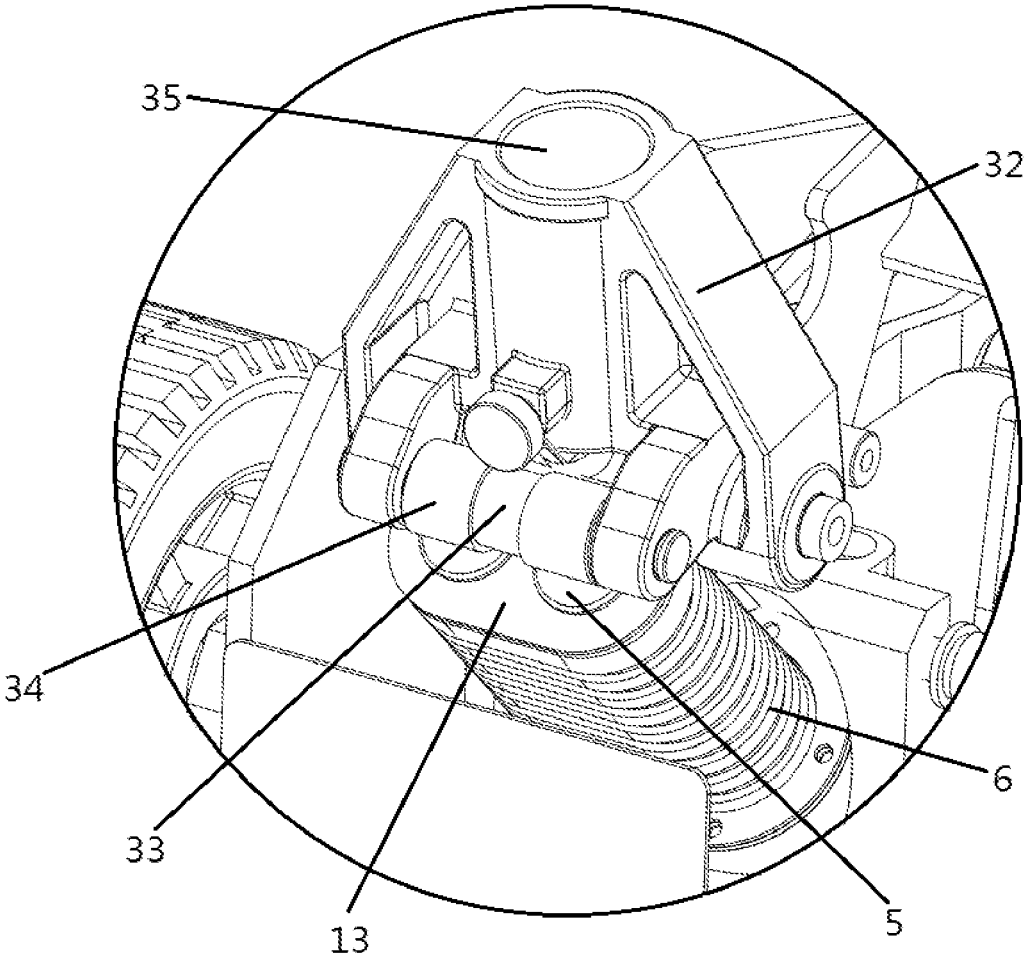
FIG. 4 is a partial diagram of a hand-press portion and a dustproof sleeve of the present invention.
Figure 5:
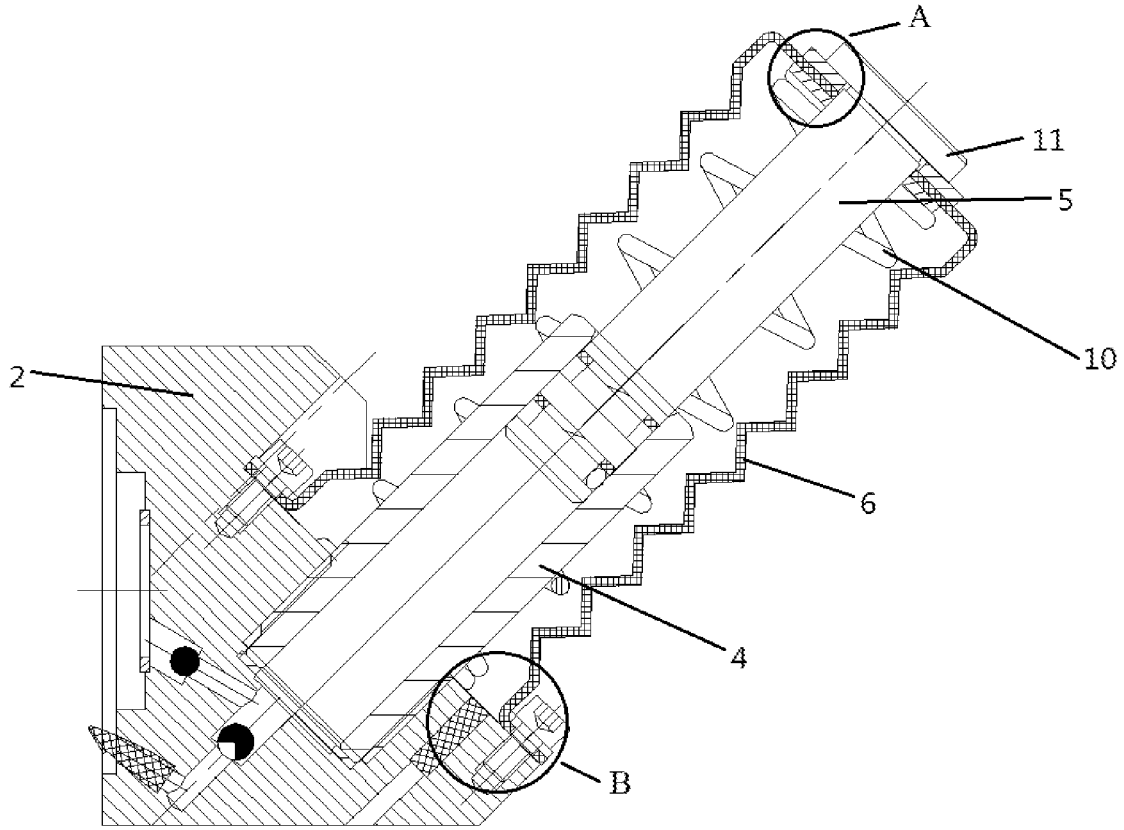
FIG. 5 is a schematic diagram of a protecting structure of the present invention.
Figure 6:
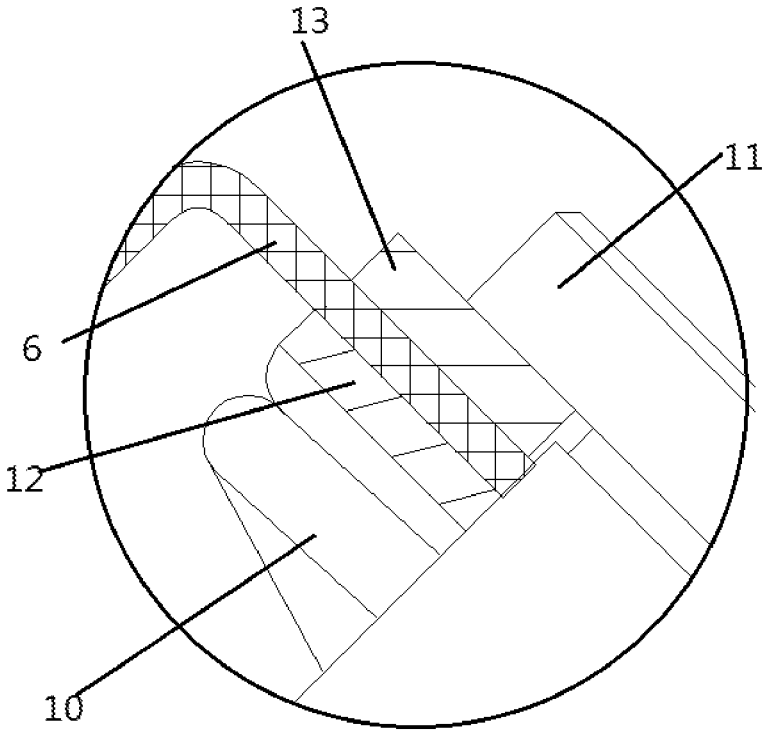
FIG. 6 is an enlarged view of the part A circled in FIG. 5 according to the present invention.
Figure 7:
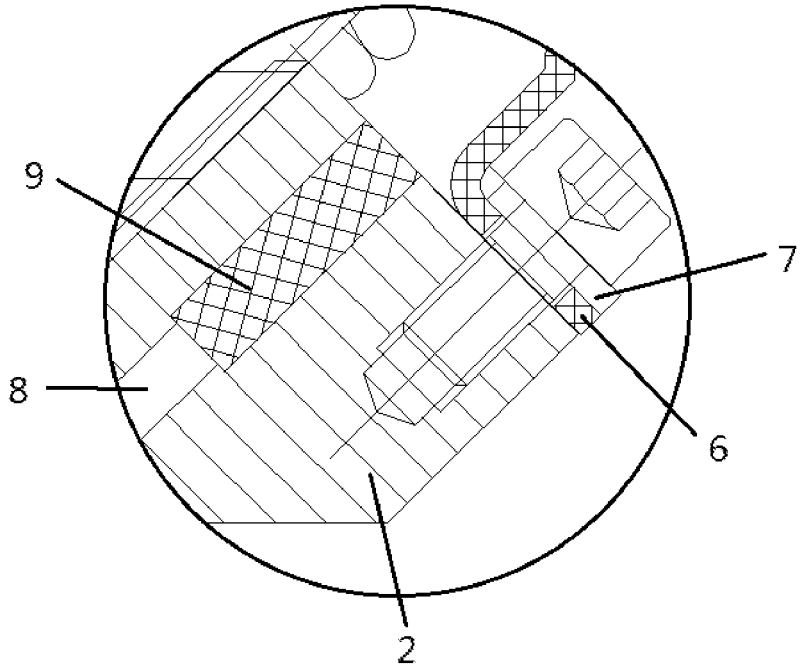
FIG. 7 is an enlarged view of the part B circled in FIG. 5 according to the present invention.

As shown in FIGS. 1-7, according to an embodiment of the present invention, a jack with a protecting structure of a pump piston includes the housing 1 and the base 2 located inside the housing 1. The oil cylinder 3 and the pump body 4 are installed on the base 2. The pump piston 5 is installed on the pump body 4. The spring 10 is installed on the pump piston 5 and the pump body 4. The stop protrusion 11 is arranged on the pump piston 5. The jack further includes the protecting structure. The protecting structure includes the dustproof sleeve 6 and the wool felt 9. The dustproof sleeve 6 is installed on the base 2 and the pump piston 5. One end of the dustproof sleeve 6 is detachably fixed on the base 2 through a fastener. The press ring 7 is installed between the dustproof sleeve 6 and the fastener. The base 2 is further provided with the vent 8, and the wool felt 9 is installed in the vent 8. The cushion plate 12 is installed between the spring 10 and the top end of the dustproof sleeve 6 of the protecting structure. The press plate 13 is installed between the top end of the dustproof sleeve 6 and the stop protrusion 11. The configuration of the dustproof sleeve 6 of the protecting structure is wave-shaped. The wheel shaft 14 is installed on the housing 1, and the wheels 15 are installed at both ends of the wheel shaft 14. The piston rod 16 is installed on the oil cylinder 3. The connecting rod 17 is installed at an end portion of the piston rod 16, and the short connecting rods 18 are installed at both ends of the connecting rod 17. The lifting arm 19 and the web plate 20 are movably installed on both sides of each of the short connecting rods 18. The lifting arm shaft 21 is installed on the housing 1, and the lifting arm sleeve 22 is installed on the lifting arm shaft 21. The web plate 20 is provided with the limit groove 37 matched with the lifting arm sleeve 22. The lifting arm 19 is movably connected to the lifting arm shaft 21 through the lifting arm sleeve 22. The long connecting rods 23 are movably installed on the lifting arm 19, and the pallet shaft 24 is movably installed on the long connecting rods 23. The pallet base 25 is installed on the pallet shaft 24, and the pallet base shaft 26 is installed on the pallet base 25.

The pallet 27 is installed on the pallet base shaft 26 through a pin. The other end of the lifting arm 19 is connected to the pallet base 25 through the pallet base shaft 26. The spacer shaft 28 is installed on the housing 1. The reinforcing plate 29 is installed on each of the lifting arm 19, the web plate 20 and the pallet base 25. The hand-press portion pin shaft 30 and the hand-press portion limit rod 31 are installed on the housing 1. The hand-press portion 32 is movably installed on the hand-press portion pin shaft 30. The hand-press portion roller shaft 33 is installed on the hand-press portion 32, and the hand-press portion rollers 34 are movably installed on the hand-press portion roller shaft 33. The hand-press portion 32 is provided with the hand-press portion socket 35, and the handle 36 is installed in the hand-press portion socket 35. The assembly mode of the protecting structure includes the following steps.

Step 1: the spring 10 is installed on the base 2 where the pump body 4 is already installed.

Step 2: the press plate 13, the dustproof sleeve 6 and the cushion plate 12 are successively sleeved on the stop protrusion 11 of the pump piston 5.

Step 3: the wool felt 9 is plugged into the vent 8 of the base 2.

Step 4: the pump piston 5 is installed on the pump body 1, wherein the press plate 13, the dustproof sleeve 6 and the cushion plate 12 have been already installed on the pump piston 5.

Step 5: the press ring 7 is sleeved into the dustproof sleeve 6, and the press ring 7 and the dustproof sleeve 6 are fixed on the base 2 through the fastener.

One end of the dustproof sleeve 6 is fixed between the press plate 13 and the cushion plate 12 through the spring 10 mounted on the pump body 4 and the stop protrusion 11 located on the pump piston. Since the spring has elasticity, the upward resilience of the spring can fix the dustproof sleeve 6 between the press plate 13 and the cushion plate 12. The stop protrusion plays a role in limiting the position of the press plate 13. The other end of the dustproof sleeve 6 is fixed on the base 2 by the fastener and the press ring 7.

The present invention provides a method for using the jack with the protecting structure of the pump piston. Firstly, the jack is manually moved to the workplace through the wheels 15, and then one end of the handle 36 is inserted into the hand-press portion socket 35. The handle 36 is pressed repeatedly by hands, and the handle 36 drives the pump piston 5 and the spring 10 through the hand-press portion rollers to perform the retractile action, while the pump piston 5 drives the dustproof sleeve 6 to perform the synchronous retractile action, so that the dustproof sleeve 6 plays a dustproof role. In the process of the synchronous retractile action of the dustproof sleeve 6, since the dustproof sleeve 6 is retractable and has elasticity, the reaction force of the spring 10 can be alleviated to prolong the service life of the spring. When the pump piston 5 performs the retractile action, the hydraulic oil is injected into the oil cylinder 3, and the pressure of the hydraulic oil in the oil cylinder 3 pushes the piston rod 16. The piston rod 16 pushes the connecting rod 17, and the connecting rod 17 drives the lifting arm 19 to move through the short connecting rods 18. The lifting arm 19 moves to drive the pallet base 25 and the pallet 27 to move upward through the action of the long connecting rods 23, thereby lifting the pallet 27 upward and playing the role of jacking up.

The present invention has the following advantages. The jack is provided with the dustproof sleeve 6, and the shape of the dustproof sleeve 6 is designed to be wavy. One end of the dustproof sleeve 6 is fixedly connected to the base 2, and the press ring 7 is added to press the bottom end of the dustproof sleeve 6 when the dustproof sleeve 6 is fixedly connected to the base 2, and then is fixed through a fastener. The tightness of the connection between the bottom end of the dustproof sleeve 6 and the base 2 is increased through the press ring 7, so as to increase the seal to prevent dust from entering the gap at the bottom end. The other end of the dustproof sleeve 6 is connected to an end portion of the pump piston 5. First, the dustproof sleeve 6 is connected to the pump piston 5 by interference fit, which increases the tightness of the connection between an end portion of the dustproof sleeve 6 and the pump piston 5. The cushion plate 12 and the press plate 13 are arranged at both ends of the end portion of the dustproof sleeve 6. One end of the end portion of the dustproof sleeve 6 is in contact with the spring 10 through the cushion plate 12, and the other end of the end portion of the dustproof sleeve 6 is in contact with the stop protrusion 11 through the press plate 13. In the process of the retractile action of the dustproof sleeve 6, the cushion plate 12 and the press plate 13 are configured to ensure the interference connection between the end portion of the dustproof sleeve 6 and the pump piston 5, so as to avoid the occurrence of a gap at the connection between the end portion of the dustproof sleeve 6 and the pump piston 5 due to the deformation of the end portion of the dustproof sleeve 6 caused by the retractile action. By installing the spring 10 on the pump piston 5, in the process of the retractile action of the pump piston 5, the dustproof sleeve 6 can effectively retract and stretch within the whole stroke of the pump piston 5 through the reset force of the spring 10 to effectively prevent dust. When the pump piston 5 is lifted to drive the dustproof sleeve 6 to move upward, the vent 8 is arranged in the base 2 to draw the air into the dustproof sleeve 6 and cause the dustproof sleeve 6 to stretch, which avoids the retraction of the dustproof sleeve 6 due to lack of internal air. When the pump piston 5 retracts, the air in the dustproof sleeve 6 is discharged through the vent 8. The wool felt 9 is installed in the vent 8 to prevent dust from entering the dustproof sleeve 6 via the vent 8 to effectively prevent secondary contamination. The reinforcing plate 29 is installed on the lifting arm 19, the web plate 20 and the pallet base 25, so as to increase the firmness and stability of the structure of the jack. The hand-press portion limit rod 31 is installed on the housing 1 to prevent the handle 36 from being pressed reversely.

The scope of protection of the present invention is not limited to the above embodiments and the transformations thereof. General modifications and replacements made by those skilled in the art based on the contents of the embodiments of the present invention shall fall within the scope of protection of the present invention.

What is claimed is:

1. A jack with a protecting structure of a pump piston, comprising a housing, a base located inside the housing, and the protecting structure; wherein an oil cylinder and a pump body are installed on the base; a pump piston is installed on the pump body; a spring is installed on the pump piston and the pump body; a stop protrusion is arranged on the pump piston; the protecting structure comprises a dustproof sleeve and a wool felt; the dustproof sleeve is installed on the base and the pump piston; a first end of the dustproof sleeve is detachably fixed on the base through a fastener; a press ring is installed between the dustproof sleeve and the fastener; the base is further provided with a vent, and the wool felt is installed in the vent;

wherein a wheel shaft is installed on the housing, and wheels are installed at both ends of the wheel shaft; a piston rod is installed on the oil cylinder; a connecting rod is installed at an end portion of the piston rod, and short connecting rods are installed at both ends of the connecting rod and wherein a lifting arm and a web plate are movably installed on both sides of each of the short connecting rods; a lifting arm shaft is installed on the housing, and a lifting arm sleeve is installed on the lifting arm shaft the web plate is provided with a limit groove, wherein the limit groove is matched with the lifting arm sleeve; the lifting arm is movably connected to the lifting arm shaft through the lifting arm sleeve.

2. The jack according to claim 1, wherein a cushion plate is installed between the spring and a second end of the dustproof sleeve of the protecting structure, wherein the second end of the dustproof sleeve is a top end of the dustproof sleeve; a press plate is installed between the top end of the dustproof sleeve and the stop protrusion.

3. The jack according to claim 1, wherein long connecting rods are movably installed on a first end of the lifting arm, and a pallet shaft is movably installed on the long connecting rods; a pallet base is installed on the pallet shaft, and a pallet base shaft is installed on the pallet base; a pallet is installed on the pallet base shaft through a pin; a second end of the lifting arm is connected to the pallet base through the pallet base shaft; a spacer shaft is installed on the housing; and a reinforcing plate is installed on each of the lifting arm, the web plate and the pallet base.

4. The jack according to claim 1, wherein a hand-press portion pin shaft and a hand-press portion limit rod are installed on the housing; a hand-press portion is movably installed on the hand-press portion pin shaft; a hand-press portion roller shaft is installed on the hand-press portion, and hand-press portion rollers are movably installed on the hand-press portion roller shaft; the hand-press portion is provided with a hand-press portion socket, and a handle is installed in the hand-press portion socket.

5. The jack according to claim 1, wherein a configuration of the dustproof sleeve of the protecting structure is wave-shaped.

6. The jack according to claim 5, wherein an assembly mode of the protecting structure comprises:

step 1: installing the spring on the base, wherein the pump body is already installed on the base;

step 2: successively sleeving a press plate, the dustproof sleeve and a cushion plate on the stop protrusion of the pump piston;

step 3: plugging the wool felt into the vent of the base;

step 4: installing the pump piston on the pump body, wherein the press plate, the dustproof sleeve and the cushion plate have been already installed on the pump piston; and step 5: sleeving the press ring into the dustproof sleeve, and fixing the press ring and the dustproof sleeve on the base through the fastener.

7. A method for using the jack with the protecting structure of the pump piston according to claim 1, comprising:

firstly, manually moving the jack to a workplace through wheels, and then inserting one end of a handle into a hand-press portion socket;

repeatedly pressing the handle by hands, wherein the handle drives the pump piston and the spring through the hand-press portion rollers to perform a retractile action, and the pump piston drives the dustproof sleeve to perform a synchronous retractile action; the dustproof sleeve plays a dustproof role; in the process of the synchronous retractile action of the dustproof sleeve, the dustproof sleeve has an elastic characteristic to alleviate a reaction force of the spring during return to prolong a service life of the spring; and when the pump piston performs the retractile action, injecting a hydraulic oil into the oil cylinder, wherein a pressure of the hydraulic oil in the oil cylinder pushes a piston rod; the piston rod pushes a connecting rod, and the connecting rod drives a lifting arm to move through short connecting rods; the lifting arm moves to drive a pallet base and a pallet to move upward through an action of long connecting rods; the lifting arm lifts the pallet upward, and the lifting arm plays a role of jacking up.

8. The method according to claim 7, wherein a cushion plate is installed between the spring and a second end of the dustproof sleeve of the protecting structure, wherein the second end of the dustproof sleeve is a top end of the dustproof sleeve; a press plate is installed between the top end of the dustproof sleeve and the stop protrusion.

9. The method according to claim 7, wherein a configuration of the dustproof sleeve of the protecting structure is wave-shaped.

10. The method according to claim 7, wherein the long connecting rods are movably installed on a first end of the lifting arm, and a pallet shaft is movably installed on the long connecting rods; the pallet base is installed on the pallet shaft, and a pallet base shaft is installed on the pallet base; the pallet is installed on the pallet base shaft through a pin; a second end of the lifting arm is connected to the pallet base through the pallet base shaft; a spacer shaft is installed on the housing; and a reinforcing plate is installed on each of the lifting arm, the web plate and the pallet base.

11. The method according to claim 7, wherein a hand-press portion pin shaft and a hand-press portion limit rod are installed on the housing; a hand-press portion is movably installed on the hand-press portion pin shaft; a hand-press portion roller shaft is installed on the hand-press portion, and hand-press portion rollers are movably installed on the hand-press portion roller shaft; the hand-press portion is provided with the hand-press portion socket, and the handle is installed in the hand-press portion socket.

12. The method according to claim 7, wherein an assembly mode of the protecting structure comprises:

step 1: installing the spring on the base, wherein the pump body is already installed on the base;

step 2: successively sleeving the press plate, the dustproof sleeve and the cushion plate on the stop protrusion of the pump piston;

step 3: plugging the wool felt into the vent of the base;

step 4: installing the pump piston on the pump body, wherein a press plate, the dustproof sleeve and a cushion plate have been already installed on the pump piston; and step 5: sleeving the press ring into the dustproof sleeve, and fixing the press ring and the dustproof sleeve on the base through the fastener.

13. The method according to claim 12, wherein a second end of the dustproof sleeve is fixed between the press plate and the cushion plate through the spring mounted on the pump body and the stop protrusion located on the pump piston; and the first end of the dustproof sleeve is fixed on the base by the fastener and the press ring.

14. A jack with a protecting structure of a pump piston, comprising a housing, a base located inside the housing, and the protecting structure; wherein an oil cylinder and a pump body are installed on the base; a pump piston is installed on the pump body; a spring is installed on the pump piston and the pump body; a stop protrusion is arranged on the pump piston; the protecting structure comprises a dustproof sleeve and a wool felt the dustproof sleeve is installed on the base and the pump piston; a first end of the dustproof sleeve is detachably fixed on the base through a fastener; a press ring is installed between the dustproof sleeve and the fastener; the base is further provided with a vent, and the wool felt is installed in the vent, wherein an assembly mode of the protecting structure comprises:

step 1: installing the spring on the base, wherein the pump body is already installed on the base;

step 2: successively sleeving a press plate, the dustproof sleeve and a cushion plate on the stop protrusion of the pump piston;

step 3: plugging the wool felt into the vent of the base;

step 4: installing the pump piston on the pump body, wherein the press plate, the dustproof sleeve and the cushion plate have been already installed on the pump piston; and step 5: sleeving the press ring into the dustproof sleeve, and fixing the press ring and the dustproof sleeve on the base through the fastener.

15. The jack according to claim 14, wherein a second end of the dustproof sleeve is fixed between the press plate and the cushion plate through the spring mounted on the pump body and the stop protrusion located on the pump piston; and the first end of the dustproof sleeve is fixed on the base by the fastener and the press ring.

16. A jack with a protecting structure of a pump piston, comprising a housing, a base located inside the housing, and the protecting structure; wherein an oil cylinder and a pump body are installed on the base; a pump piston is installed on the pump body; a spring is installed on the pump piston and the pump body; a stop protrusion is arranged on the pump piston; the protecting structure comprises a dustproof sleeve and a wool felt the dustproof sleeve is installed on the base and the pump piston; a first end of the dustproof sleeve is detachably fixed on the base through a fastener; a press ring is installed between the dustproof sleeve and the fastener; the base is further provided with a vent, and the wool felt is installed in the vent, wherein a cushion plate is installed between the spring and a second end of the dustproof sleeve of the protecting structure, wherein the second end of the dustproof sleeve is a top end of the dustproof sleeve; a press plate is installed between the top end of the dustproof sleeve and the stop protrusion, wherein an assembly mode of the protecting structure comprises:

step 1: installing the spring on the base, wherein the pump body is already installed on the base;

step 2: successively sleeving the press plate, the dustproof sleeve and the cushion plate on the stop protrusion of the pump piston;

step 3: plugging the wool felt into the vent of the base;

step 4: installing the pump piston on the pump body, wherein the press plate, the dustproof sleeve and the cushion plate have been already installed on the pump piston; and step 5: sleeving the press ring into the dustproof sleeve, and fixing the press ring and the dustproof sleeve on the base through the fastener.

* * * * *